US011441871B1

(12) United States Patent
Weber

(10) Patent No.: US 11,441,871 B1
(45) Date of Patent: Sep. 13, 2022

(54) CONCEALMENT HOLSTER ASSEMBLY

(71) Applicant: Weber Tactical LLC, O'Fallon, MO (US)

(72) Inventor: Adam Weber, O'Fallon, MO (US)

(73) Assignee: WEBER TACTICAL LLC, O'Fallon, MO (US)

( * ) Notice: Subject to any disclaimer, the term of this patent is extended or adjusted under 35 U.S.C. 154(b) by 0 days.

(21) Appl. No.: 17/368,969

(22) Filed: Jul. 7, 2021

(51) Int. Cl.
*F41C 33/04* (2006.01)
*F41C 33/02* (2006.01)

(52) U.S. Cl.
CPC ..... *F41C 33/048* (2013.01); *F41C 33/0236* (2013.01); *F41C 33/041* (2013.01)

(58) Field of Classification Search
CPC .. F41C 33/048; F41C 33/041; F41C 33/0236; F41C 33/0209; F41C 33/02
See application file for complete search history.

(56) References Cited

U.S. PATENT DOCUMENTS 7,314,152 B1 * 1/2008 Garrett ..... F41C 33/041 224/672
9,267,760 B2 * 2/2016 Slinkard ..... F41C 33/0227
9,829,276 B2 * 11/2017 Laemmlen ..... F41C 33/048
10,684,094 B2 * 6/2020 Shinkle ..... F41C 33/0209
11,255,635 B1 * 2/2022 Shults ..... F41C 33/045
2014/0027486 A1 * 1/2014 McGee ..... F41C 33/048 224/587
2014/0158733 A1 * 6/2014 McDonnell ..... F41C 33/048 224/269
2015/0034684 A1 * 2/2015 Tedder ..... F41C 33/041 224/242
2016/0370144 A1 * 12/2016 Laemmlen ..... H04B 1/3888
2018/0010885 A1 * 1/2018 Tedder ..... F41C 33/0209
2021/0215455 A1 * 7/2021 Taher ..... F41C 33/04
2021/0310766 A1 * 10/2021 Haygood ..... F41C 33/0227

OTHER PUBLICATIONS

Published Jul. 8, 2020, Accessed Jul. 6, 2021; Website—https://www.youtube.com/watch?v=fmPxatNoJOc.
Published Mar. 4, 2020, Accessed Jul. 6, 2021; Website—https://www.amazon.com/HolsterBuilder-Modwing-Holster-Claw-Concealment/dp/B085H7L29G.
Published Jul. 5, 2021 (Product Available In 2011); Website—https://www.webertactical.com/product/sti-2011-gamer-holster/#hand.

* cited by examiner

*Primary Examiner* — Corey N Skurdal
(74) *Attorney, Agent, or Firm* — Sandberg Phoenix & von Gontard PC

(57) ABSTRACT

A concealment holster assembly, capable of being worn in multiple positions, includes a unitary shell, a belt attachment body, a forward belt loop, and a rearward belt loop. The unitary shell is capable of holstering a firearm and has a front side portion, inside portion, and outside portion. The belt attachment body is couplable to the unitary shell and is of unitary construction and includes a complementary shell portion, a forward flange, and a rearward flange. The forward flange and rearward flanges are angled inward. A forward belt loop and rearward belt loop are couplable to the forward and rearward flanges, respectively, to cause the belt attachment body, when worn on a belt, to flex inward toward a body of a wearer and increase concealment of the concealment holster and a firearm when the firearm is holstered.

20 Claims, 16 Drawing Sheets

CONCEALMENT HOLSTER ASSEMBLY

CROSS-REFERENCE TO RELATED APPLICATIONS

Not Applicable.

STATEMENT REGARDING FEDERALLY SPONSORED RESEARCH

Not Applicable.

BACKGROUND

Law abiding firearms owners often have a need to carry a firearm, typically a handgun, in a concealed manner. For example, a firearm owner may desire to carry a concealed handgun for self-defense. Concealment holsters, generally, are handgun holsters that are worn by a user to carry a handgun removably within the holster and that aid in the concealment of the holster and the handgun.

Typically, concealment holsters are used in one of two main carrying positions. A first position is in appendix carry (e.g., one o'clock position) where the holster and firearm are positioned in front of a user and inside the waistband. A second typical position is on the hip and inside the waistband (e.g., strong side 4 o'clock position). Another possible position is on the hip and outside the waistband.

Typically, a concealment holster is only capable of being worn in a single position. Concealment holsters that are capable of multi-position use are incapable of both inside the waistband and outside the waistband wearing.

Concealment holsters are intended to conceal the firearm or handgun carried in the holster. However, concealment holsters struggle to conceal handguns given the size and shape of handguns. For example, the grip of the handgun will typically protrude outwardly from a wearer of the concealment holster and is thus more likely to be visible to others. Concealment holsters also struggle to conceal firearms when the concealment holster is worn outside the waistband. By positioning the concealment holster outside the waistband, the wearer's pants or other clothing may not contribute to the concealment of the holster and/or handgun. Furthermore, the holster and/or firearm may protrude more from the wearer's body.

Given the shortcomings of existing concealment holsters, what is needed is a multi-position concealment holster capable of being worn inside or outside the waistband at positions including appendix carry inside the waistband, on the hip and inside the waistband, and on the hip and outside the waistband. What is also needed is a concealment holster with features that improve concealment of the holster and/or handgun when the concealment holster is worn externally to the waistband.

BRIEF SUMMARY

Briefly, a concealment holster assembly, method of use, and method of manufacture are disclosed. The disclosed concealment holster assembly provides several advantages. The concealment holster assembly provides for a user to modify a concealment holster to wear in a variety of carry configurations including an inside the waist appendix position, and inside the waist hip position, and an outside the waist hip position. The concealment carry assembly also provides for a concealment holster worn in the outside the waist hip position with enhanced concealment resulting from the structure and geometry of the components of the concealment holster when configured for carry in such a position.

In one embodiment, a concealment holster assembly, capable of being worn in multiple positions, includes a unitary shell, a belt attachment body, a forward belt loop, and a rearward belt loop. The unitary shell has a front side portion, inside portion, and outside portion. The inside portion is adapted and configured to face a wearer when the concealment holster is worn, and the outside portion is adapted and configured to face away from a wearer when the concealment holster is worn. The front side portion joins the inside portion and the outside portion. The inside portion has a terminal end portion, and the outside portion has a terminal end portion. Each terminal end portion terminates in an edge. The terminal end portion of the inside portion and the terminal end portion of the outside portion are substantially parallel. The edge of the inside terminal end portion and the edge of the outside terminal end portion are coplanar. The unitary shell has an open top and open bottom formed by the relationship between the inside portion, front side portion, and outside portion, with the open top being sized to accommodate a firearm when inserted into the shell through the open top in a barrel first orientation. The terminal end portion of the inside portion and the terminal end portion of the outside portion are joined by a fastener. The inside portion has a plurality of through holes each adapted and configured to receive a fastener, and the outside portion has a plurality of through holes each adapted and configured to receive a fastener. The belt attachment body is of unitary construction and is adapted and configured to facilitate wearing of the concealment holster outside the waist. The belt attachment body includes a complementary shell portion, a forward flange, and a rearward flange. The belt attachment body is removably couplable to the unitary shell. The complimentary shell portion includes a plurality of through holes each adapted and configured to receive a fastener such that the belt attachment body is couplable to the unitary shell via at least two of the plurality of through holes of the outside portion of the unitary shell. The forward flange extends forward from the complementary shell portion and is angled inward toward the inside portion of the unitary shell. The forward flange includes a plurality of through holes. The rearward flange extends rearward from the complementary shell portion and is angled inward toward the inside portion of the unitary shell. The rearward flange includes a plurality of through holes. A forward belt loop is adapted and configured to be securable to a belt. The forward belt loop includes a plurality of through holes, and the forward belt loop is couplable to the forward flange of the belt attachment body using a plurality of fasteners, the plurality of through holes of the forward belt loop, and the plurality of through holes of the forward flange of the belt attachment body. A rearward belt loop is adapted and configured to be securable to a belt. The rearward belt loop includes a plurality of through holes, and the rearward belt loop is couplable to the rearward flange of the belt attachment body using a plurality of fasteners, the plurality of through holes of the rearward belt loop, and the plurality of through holes of the rearward flange of the belt attachment body. The placement of the forward belt loop on the angled forward flange and placement of the rearward belt loop on the angled rearward flange cause the belt attachment body, when worn on a belt, to flex inward toward a body of a wearer and increase concealment of the concealment holster and a firearm when the firearm is holstered.

DESCRIPTION OF THE DRAWINGS

In the accompanying drawings which form part of the specification.

DETAILED DESCRIPTION

Figure 1A:
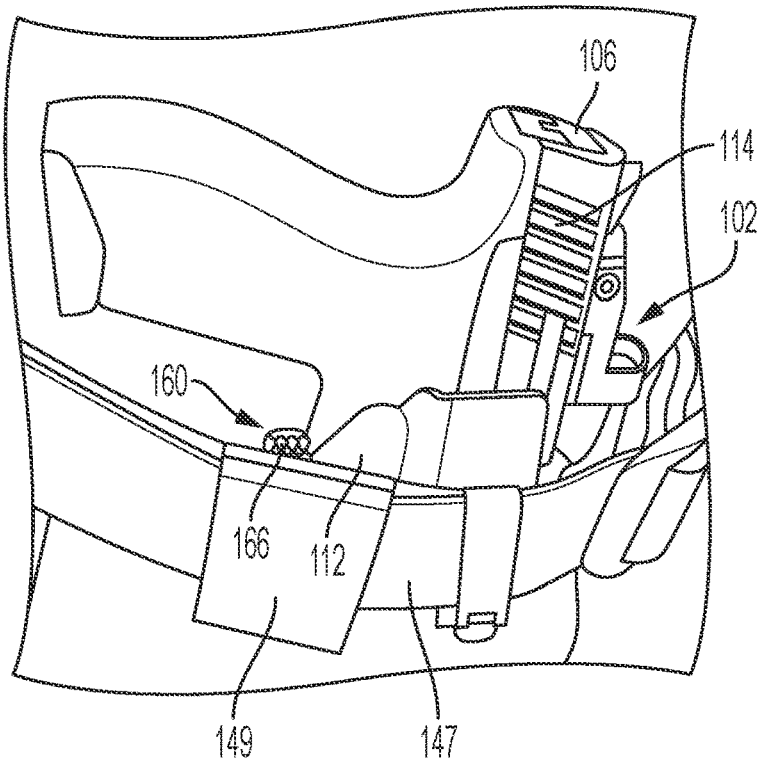
FIG. 1A illustrates the disclosed concealment holster worn in an appendix inside the waist position.

The following detailed description illustrates the disclosed concealment holster by way of example and not by way of limitation. The description enables one skilled in the art to make and use the disclosed concealment holster, describes several embodiments, adaptations, variations, alternatives, and uses of the concealment holster, including what is presently believed to be the best mode of making and using the concealment holster. Additionally, it is to be understood that the concealment holster is not limited to the details of construction and the arrangements of components set forth in the following description or illustrated in the drawings. The disclosed concealment holster is capable of other embodiments and of being practiced or being carried out in various ways. Also, it is to be understood that the phraseology and terminology used herein is for the purpose of description and should not be regarded as limiting.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Unless otherwise defined, all technical and scientific terms used herein have the same meaning as commonly understood by one of ordinary skill in the art to which this disclosure belongs. The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises", "comprising", "including", and "having" are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps can be employed.

When an element, object, device, apparatus, component, region or section, etc., is referred to as being "on", "engaged to or with", "connected to or with", or "coupled to or with" another element, object, device, apparatus, component, region or section, etc., it can be directly on, engaged, connected or coupled to or with the other element, object, device, apparatus, component, region or section, etc., or intervening elements, objects, devices, apparatuses, components, regions or sections, etc., can be present. In contrast, when an element, object, device, apparatus, component, region or section, etc., is referred to as being "directly on", "directly engaged to", "directly connected to", or "directly coupled to" another element, object, device, apparatus, component, region or section, etc., there may be no intervening elements, objects, devices, apparatuses, components, regions or sections, etc., present. Other words used to describe the relationship between elements, objects, devices, apparatuses, components, regions or sections, etc., should be interpreted in a like fashion (e.g., "between" versus "directly between", "adjacent" versus "directly adjacent", etc.).

As used herein the phrase "operably connected to" will be understood to mean two are more elements, objects, devices, apparatuses, components, etc., that are directly or indirectly connected to each other in an operational and/or cooperative manner such that operation or function of at least one of the elements, objects, devices, apparatuses, components, etc., imparts are causes operation or function of at least one other of the elements, objects, devices, apparatuses, components, etc. Such imparting or causing of operation or function can be unilateral or bilateral.

As used herein, the term "and/or" includes any and all combinations of one or more of the associated listed items. For example, A and/or B includes A alone, or B alone, or both A and B.

Although the terms first, second, third, etc. can be used herein to describe various elements, objects, devices, apparatuses, components, regions or sections, etc., these elements, objects, devices, apparatuses, components, regions or sections, etc., should not be limited by these terms. These terms may be used only to distinguish one element, object, device, apparatus, component, region or section, etc., from another element, object, device, apparatus, component, region or section, etc., and do not necessarily imply a sequence or order unless clearly indicated by the context.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) taught herein, and because many modifications may be made in the embodiments described herein, it is to be understood that the details herein are to be interpreted as illustrative and non-limiting.

Referring generally to FIGS. 1A-4D, a concealment holster assembly 100 is shown in a variety of configurations. The concealment holster assembly 100 includes all the components shown in FIGS. 2A, 3A, 3C, and 4A. For example, the concealment holster assembly 100 can be sold in kit form including all the components. The components can be assembled in the various configurations disclosed herein to provide for different carrying positions and carry styles of the type described herein. Advantageously, the concealment holster assembly 100 allows for a single concealment holster to be configured for and worn in a variety of configurations. This provides the wearer/user the ability to configure the concealment holster 102 to wear in one of a plurality of carry positions depending on the needs of the wearer/user. For example, depending on how the wearer is using the concealment holster 102 or depending on the situation in which the wearer is using the concealment holster 102, the user can configure the concealment holster 102 for the particular use and carry position that facilitates that particular use using the components provided in the concealment holster assembly 100.

Figure 1B:
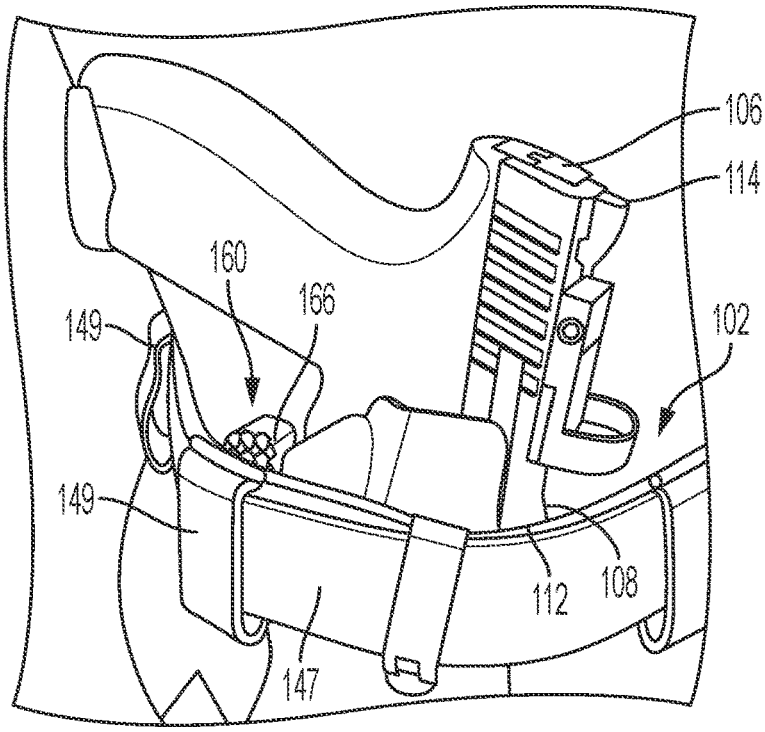
FIG. 1B illustrates the disclosed concealment holster worn in a hip inside the waist position.
Figure 1C:
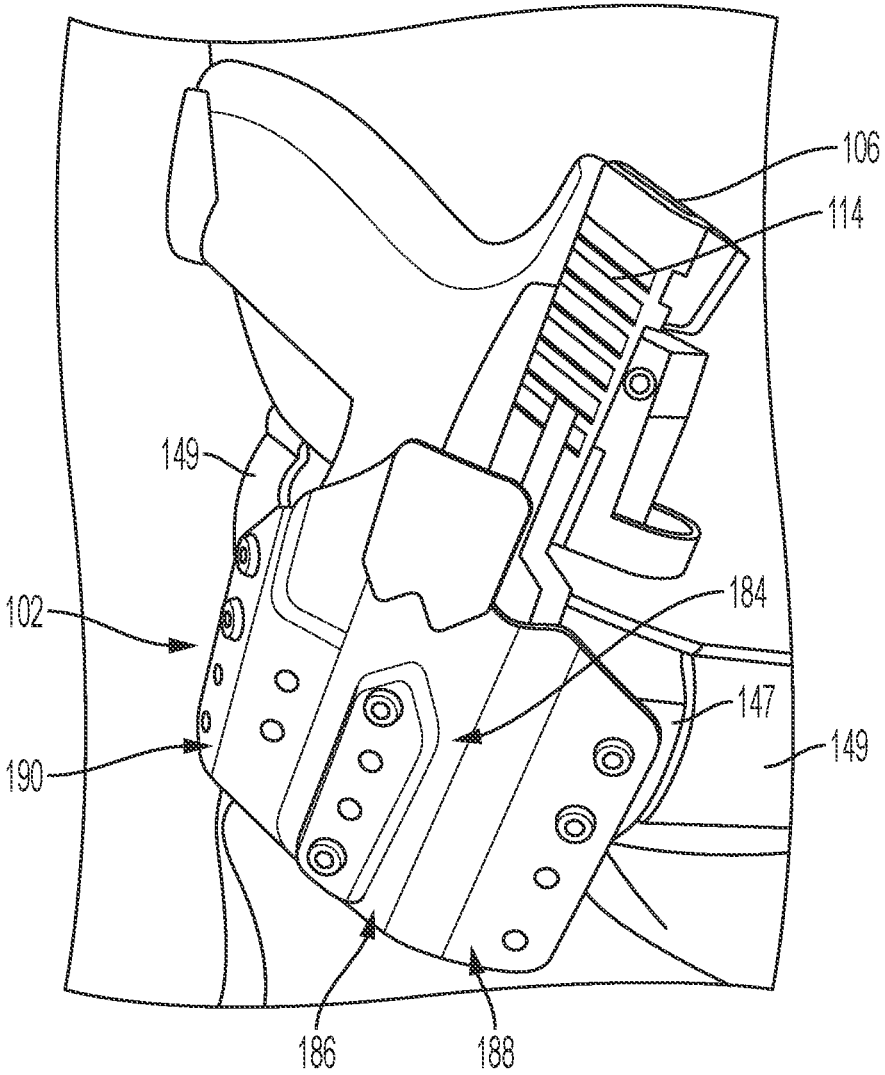
FIG. 1C illustrates the disclosed concealment holster worn in an outside the waist position.

Using the concealment holster assembly 100, a wearer can configure the concealment holster 102 for wearing in a variety of configurations. Referring to FIG. 1A, the concealment holster can be configured using the concealment holster assembly 102 for wearing in an inside the waist (inside the waistband) appendix (e.g., 1 o'clock) carry position. Referring to FIG. 1B, the concealment holster can be configured using the concealment holster assembly 102 for wearing in an inside the waist (inside the waistband) hip (e.g., 4 o'clock) carry position. Referring to FIG. 1C, the concealment holster can be configured using the concealment holster assembly 102 for wearing in an outside the waist (outside the waistband) hip (e.g., 4 o'clock) carry position.

Figure 2A:
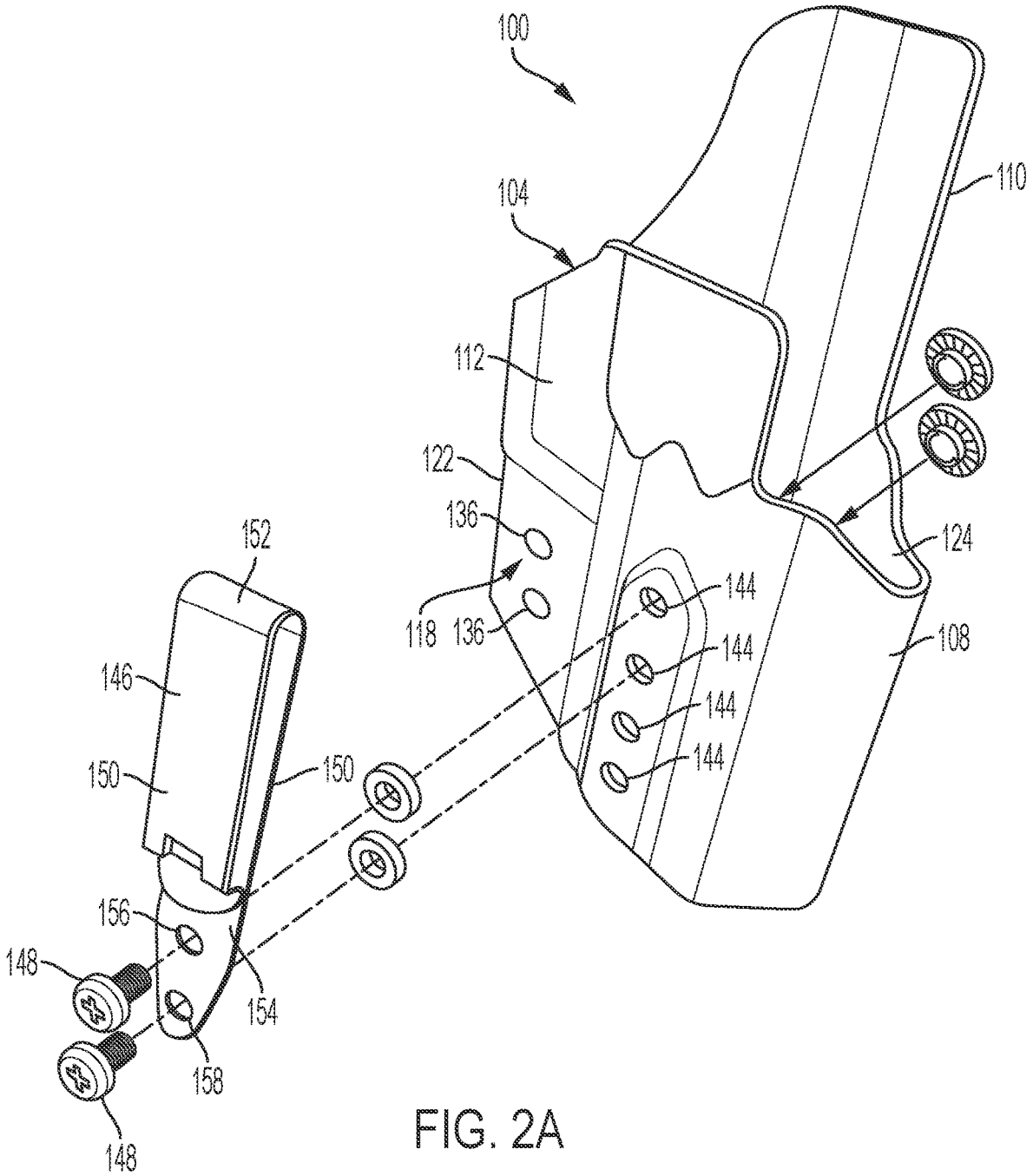
FIG. 2A illustrates assembly of the disclosed concealment holster for use in an inside the waist carry position.
Figure 2C:
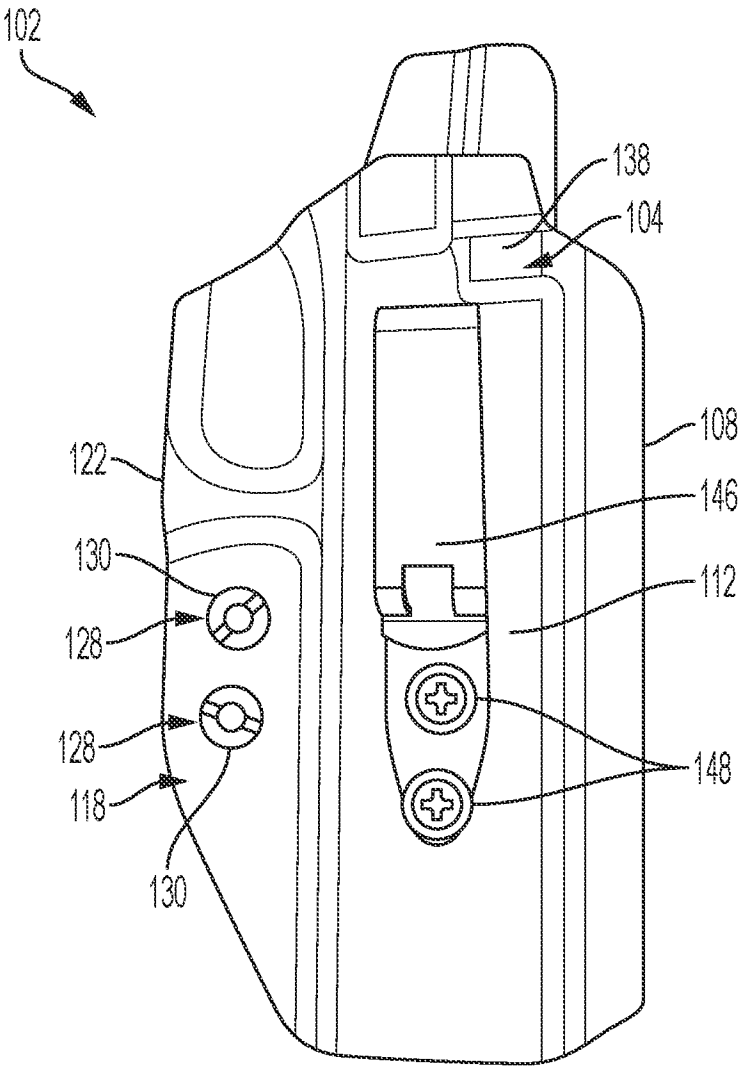
FIG. 2C illustrates and outside portion of the disclosed concealment holster in the configuration shown in FIG. 2A.
Figure 2B:
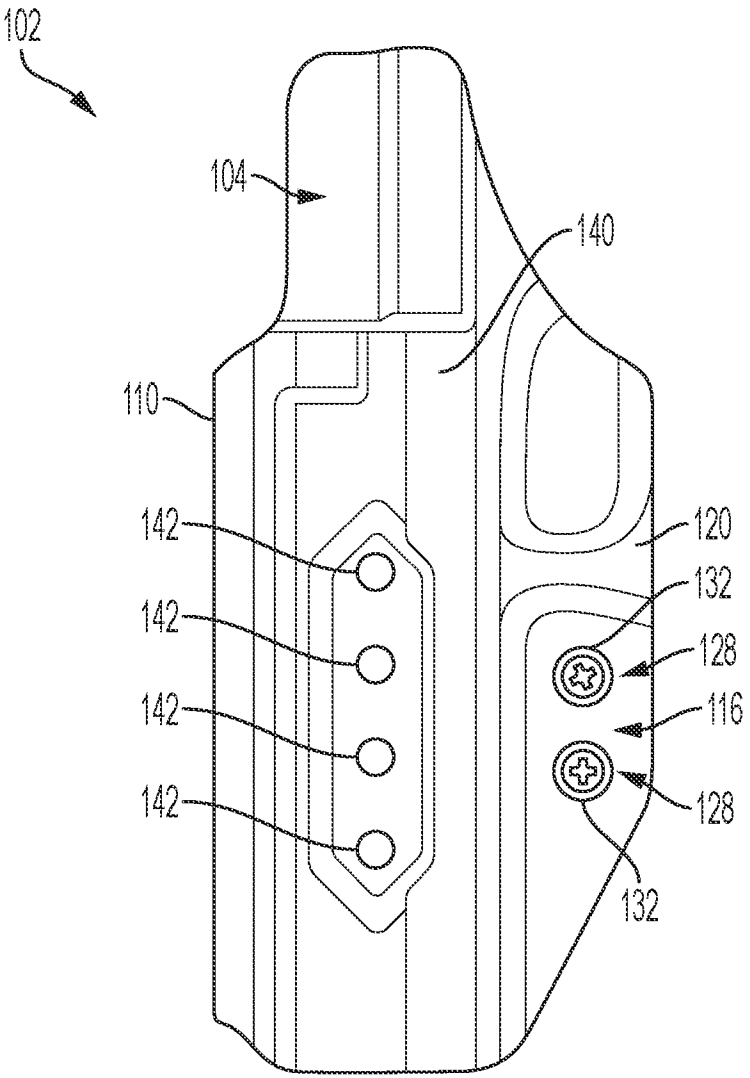
FIG. 2B illustrates and inside portion of the disclosed concealment holster in the configuration shown in FIG. 2A.

Referring to FIGS. 1A, 1B, and 2A-2C, the concealment holster 102 can be configured for wearing inside the waistband in a variety of carry positions. In this configuration, the concealment holster 102 can include a mod wing (shown in FIGS. 1A, 1B, and 3A-3I and discussed with respect thereto) or can optionally forego a mod wing as shown in FIGS. 2A-2C. To configure the concealment holster 102 for use in an inside the waist carry position, a unitary shell 104 is stripped of other components. The unitary shell 104 is adapted and configured to receive and secure a firearm (e.g., a handgun) 106.

The unitary shell 104 is consistent across all configurations of the concealment holster 102. This facilitates the configurability of the concealment holster 102 using the concealment holster assembly 100 to allow for multiple carry positions. The unitary shell 104 has a front side portion 108, inside portion 110, and outside portion 112. The inside portion 110 is adapted and configured to face a wearer when the concealment holster is worn. The outside portion 112 is adapted and configured to face away from a wearer when the concealment holster 102 is worn. The front side portion 108 joins the inside portion 110 and the outside portion 112. The front side portion 108, the inside portion 110, and the outside portion 112 collectively forming a substantially U-shaped structure with the front side portion 108 forming the curved portion of the substantially U-shaped structure. The front side portion 108, the inside portion 110, and the outside portion 112 collectively surround a firearm when a firearm is inserted between the inside portion 110 and the outside 112 portion. For example, when a handgun 106 including a slide 114 is inserted in the concealment holster 102, the slide is oriented toward the front side portion 108.

Figure 3A:
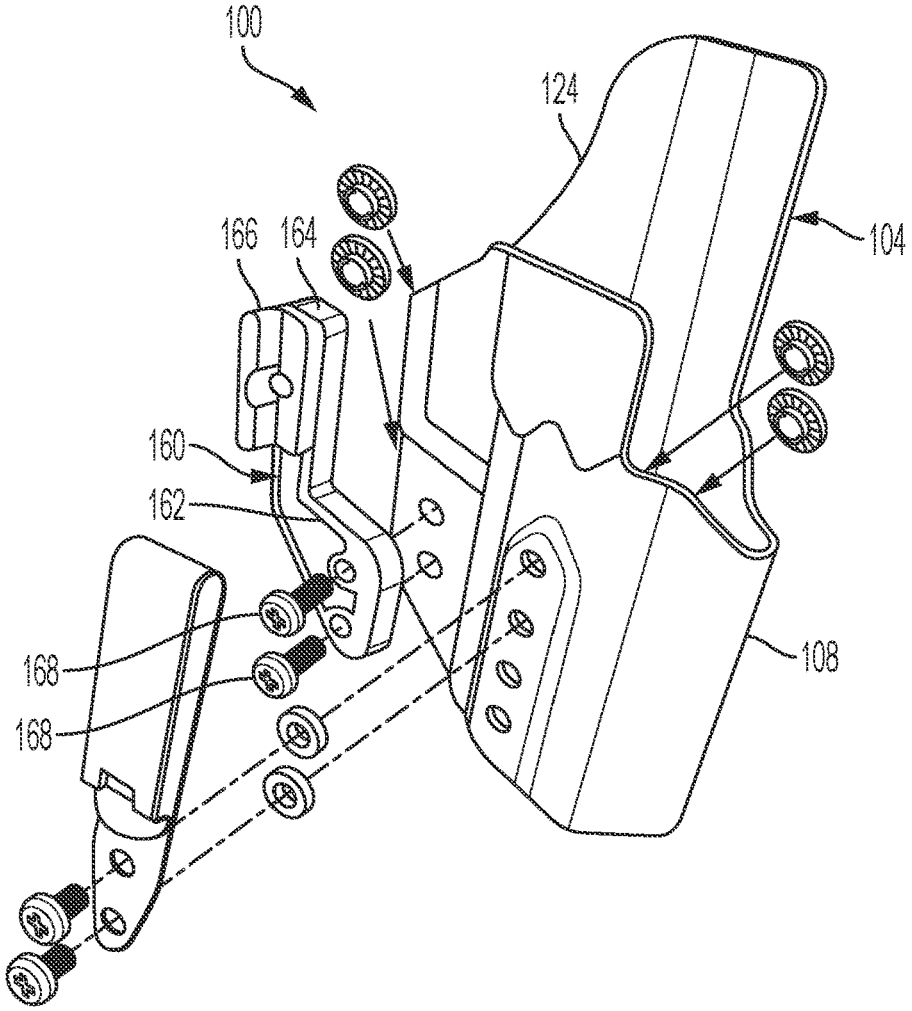
FIG. 3A illustrates assembly of the disclosed concealment holster for use in an inside the waist carry position and with a mod wing.
Figure 3B:
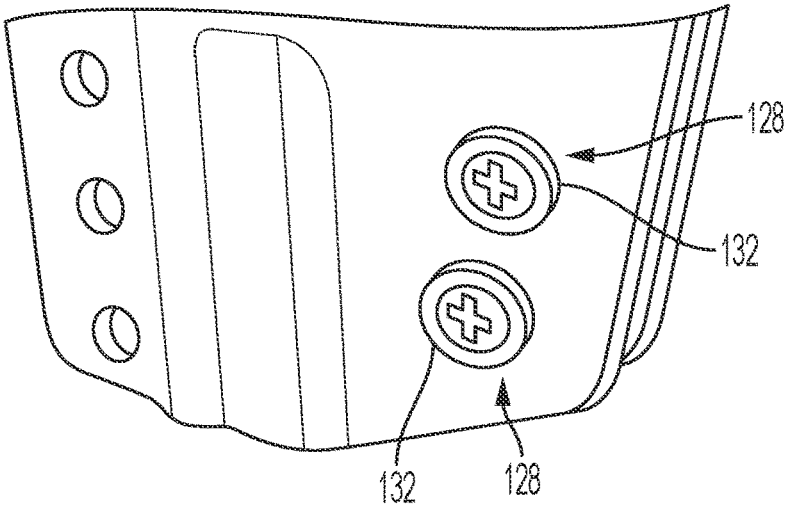
FIG. 3B illustrates a portion of a unitary shell of the concealment holster depicted in the FIGS. having fasteners for adjusting a force gripping a firearm when holstered.
Figure 3C:
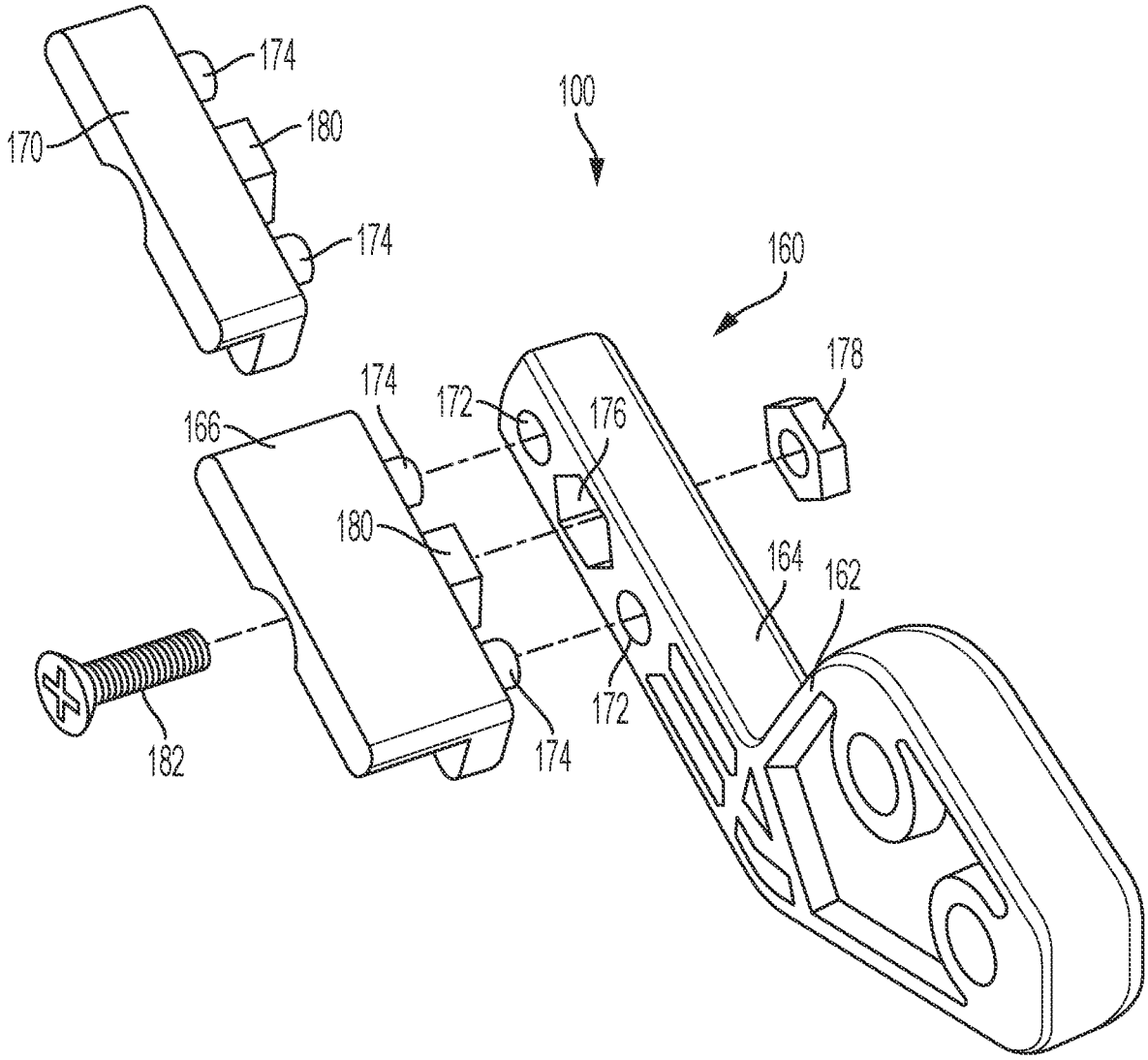
FIG. 3C illustrates assembly of a mod wing with adjustable sized spacers.
Figure 3D:
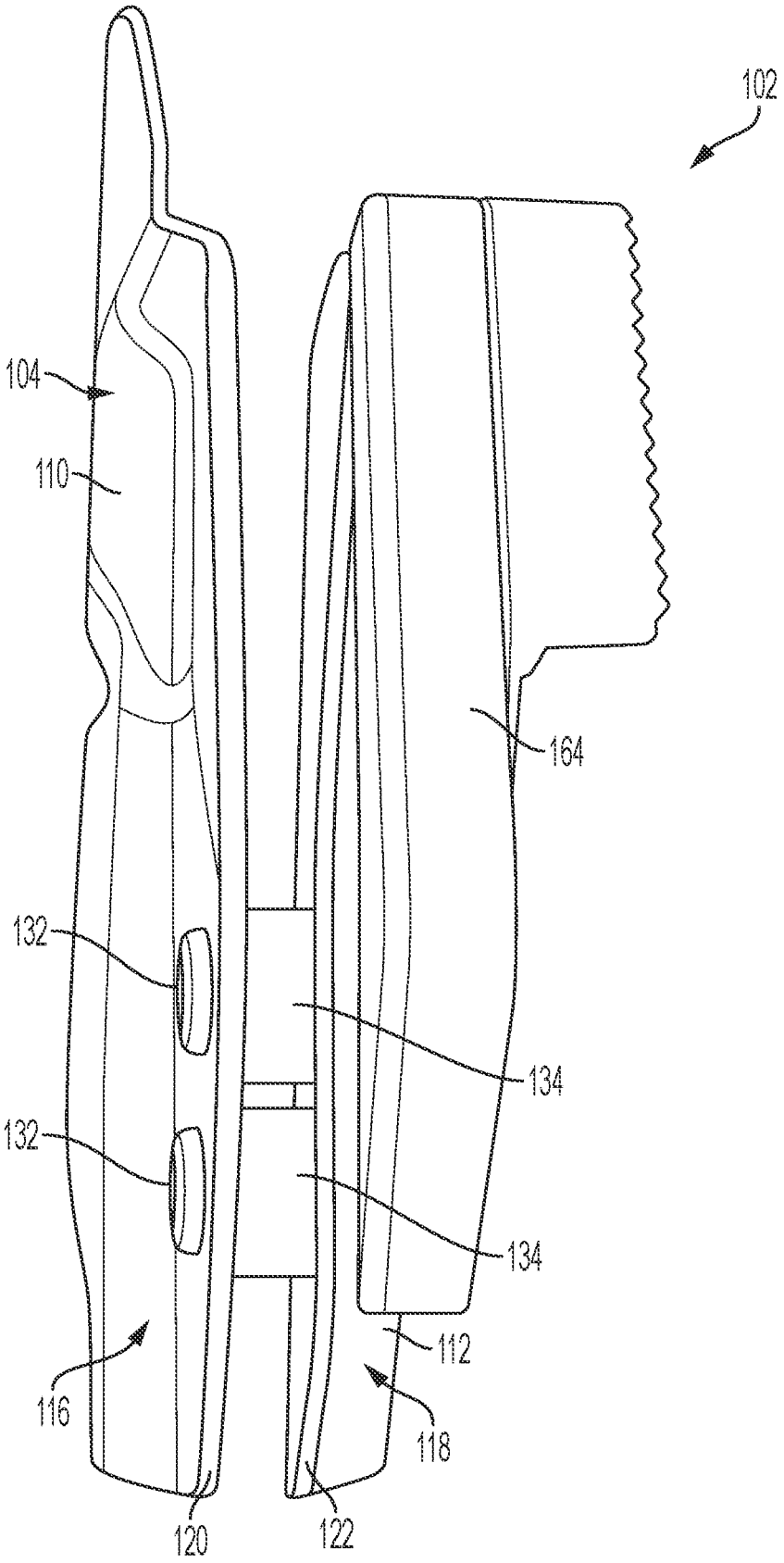
FIG. 3D illustrates a rear view of the disclosed concealment holster for use in an inside the waist carry position and with a mod wing.
Figure 3E:
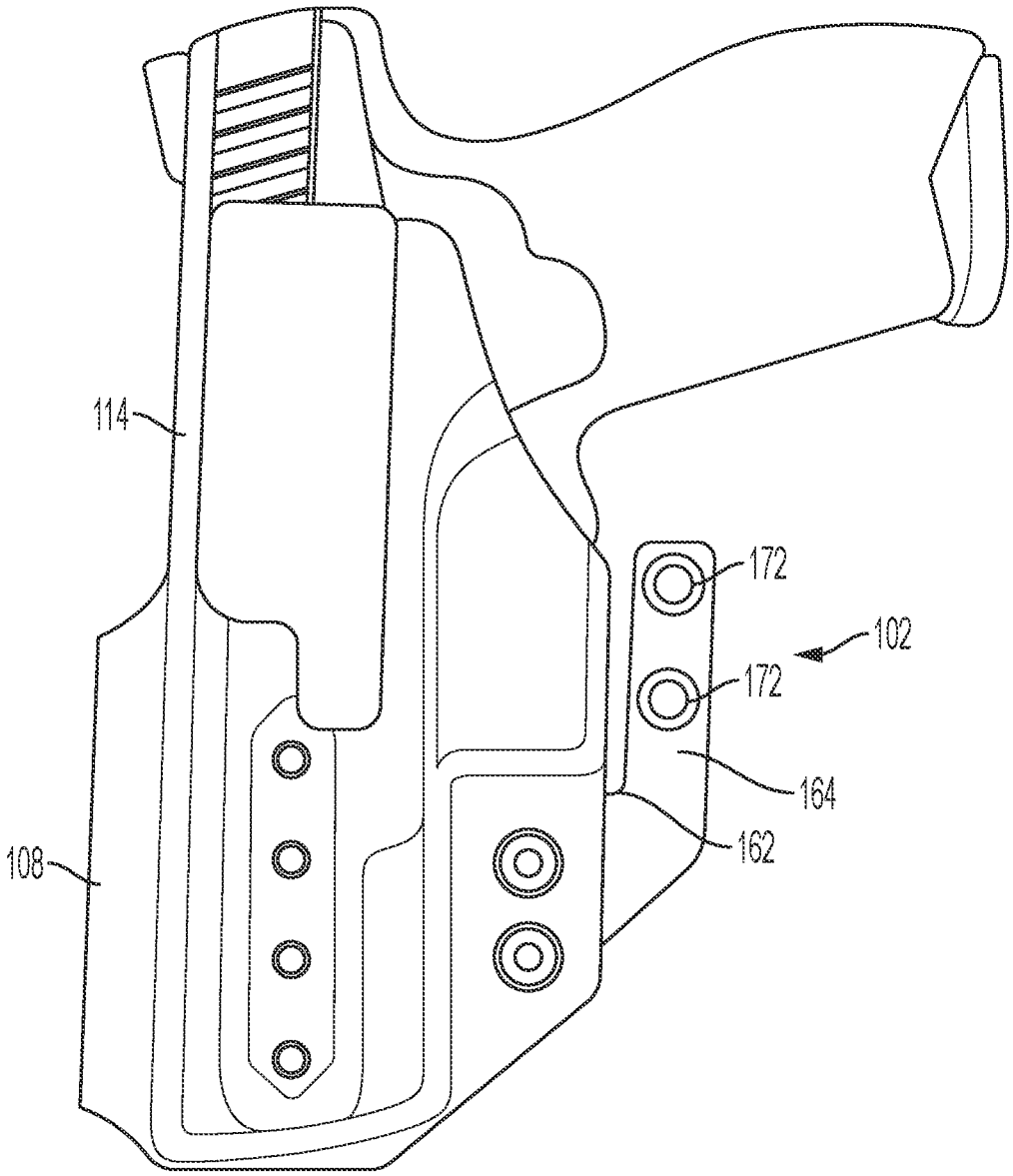
FIG. 3E illustrates an inside view of the disclosed concealment holster for use in an inside the waist carry position and with a mod wing.
Figure 3F:
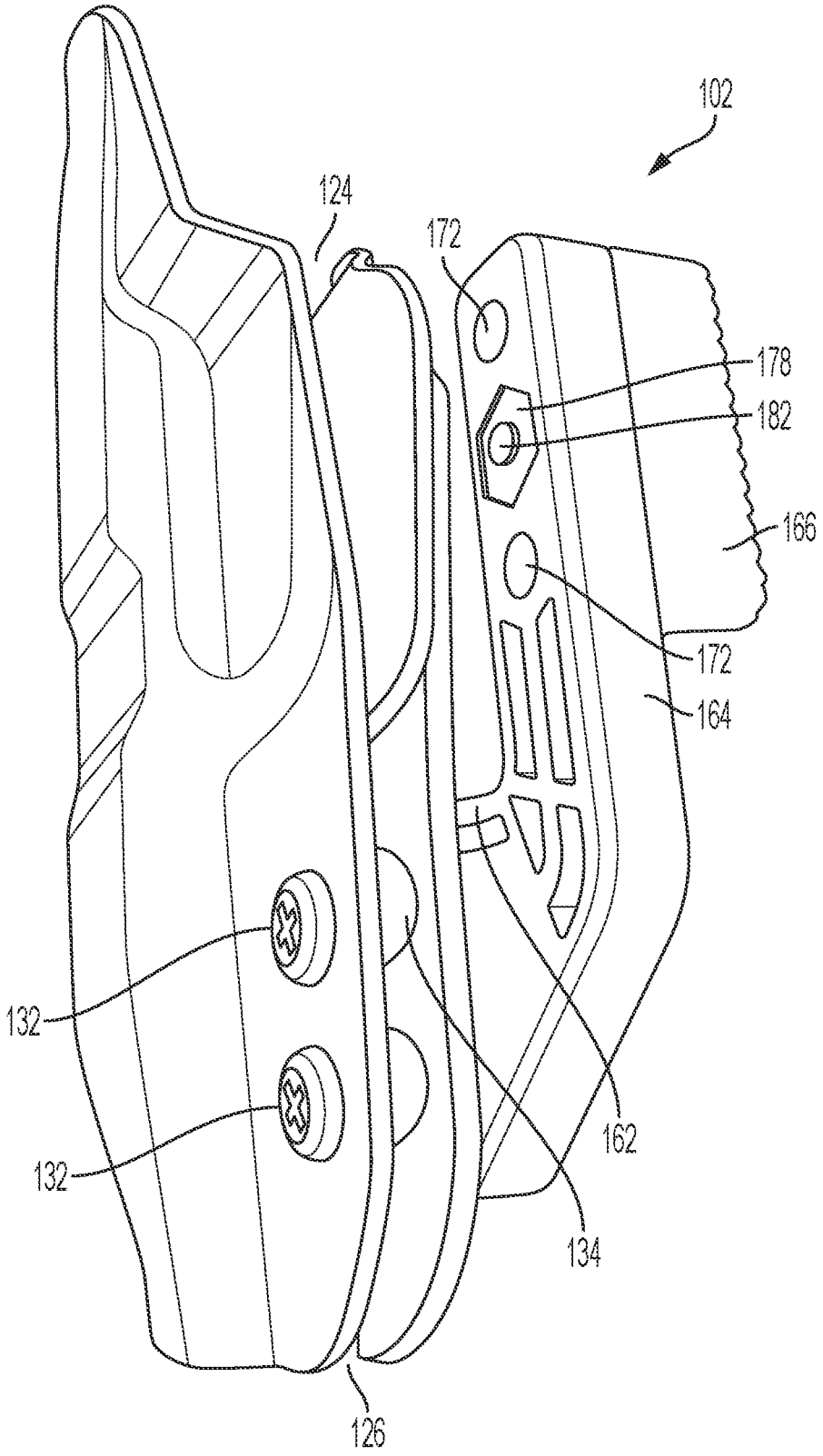
FIG. 3F illustrates an inside-rear perspective view of the disclosed concealment holster for use in an inside the waist carry position and with a mod wing.
Figure 3G:
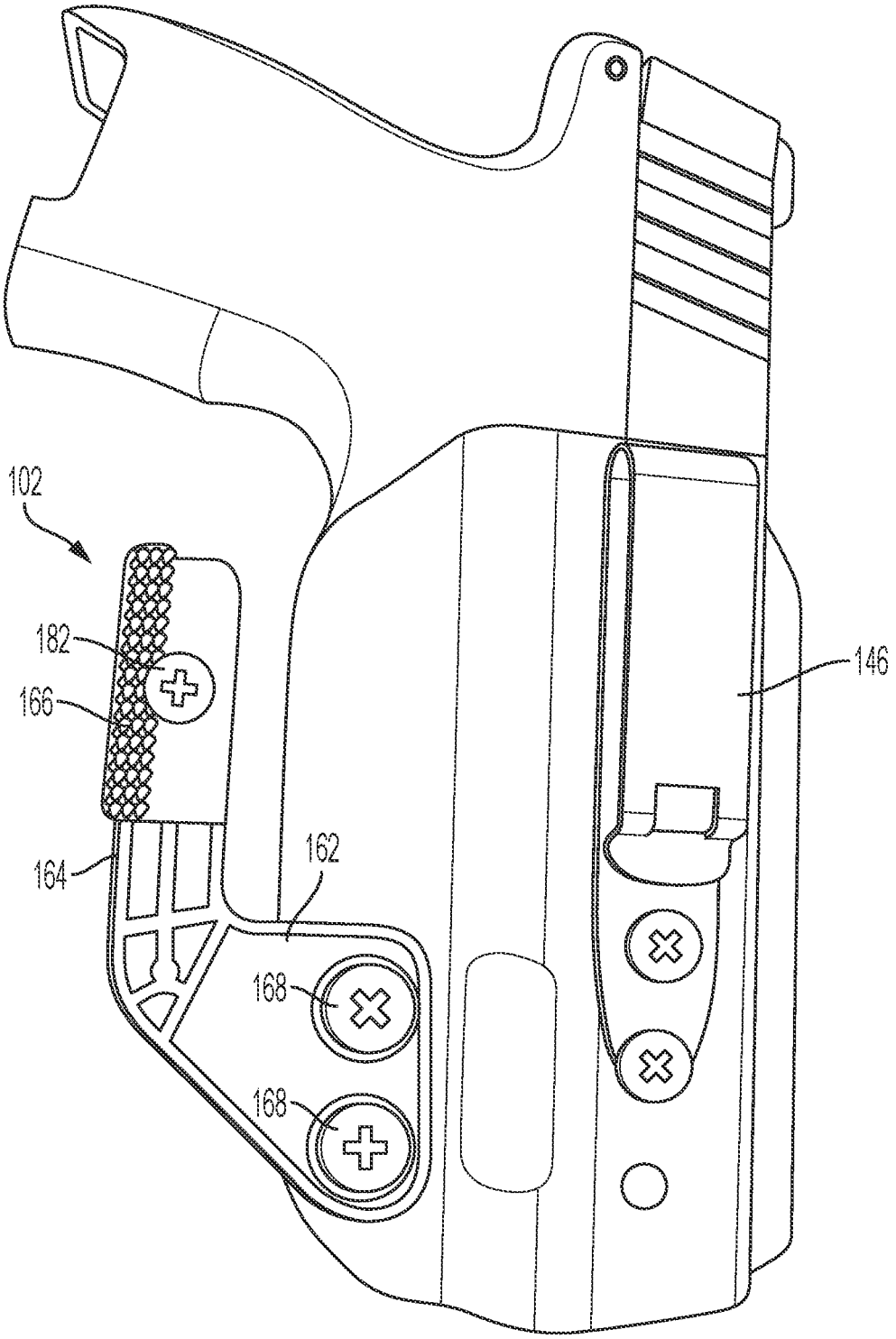
FIG. 3G illustrates an outside view of the disclosed concealment holster for use in an inside the waist carry position and with a mod wing.
Figure 3H:
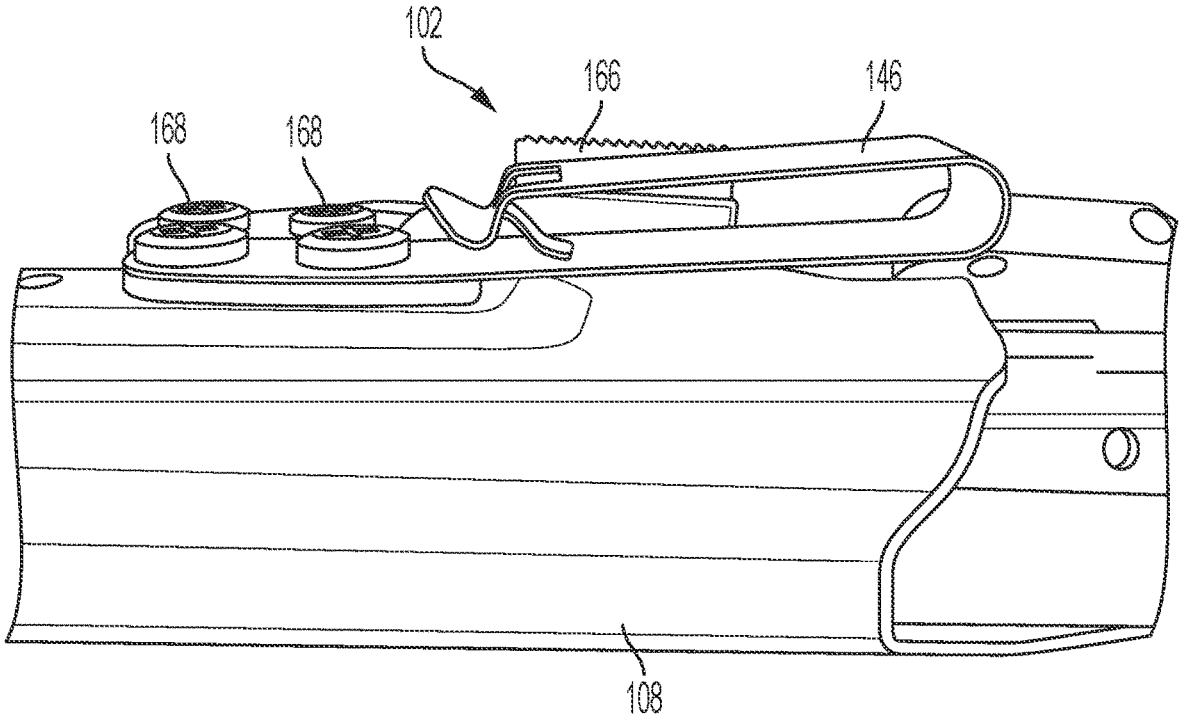
FIG. 3H illustrates a partial forward or front view of the disclosed concealment holster for use in an inside the waist carry position and with a mod wing.
Figure 3I:
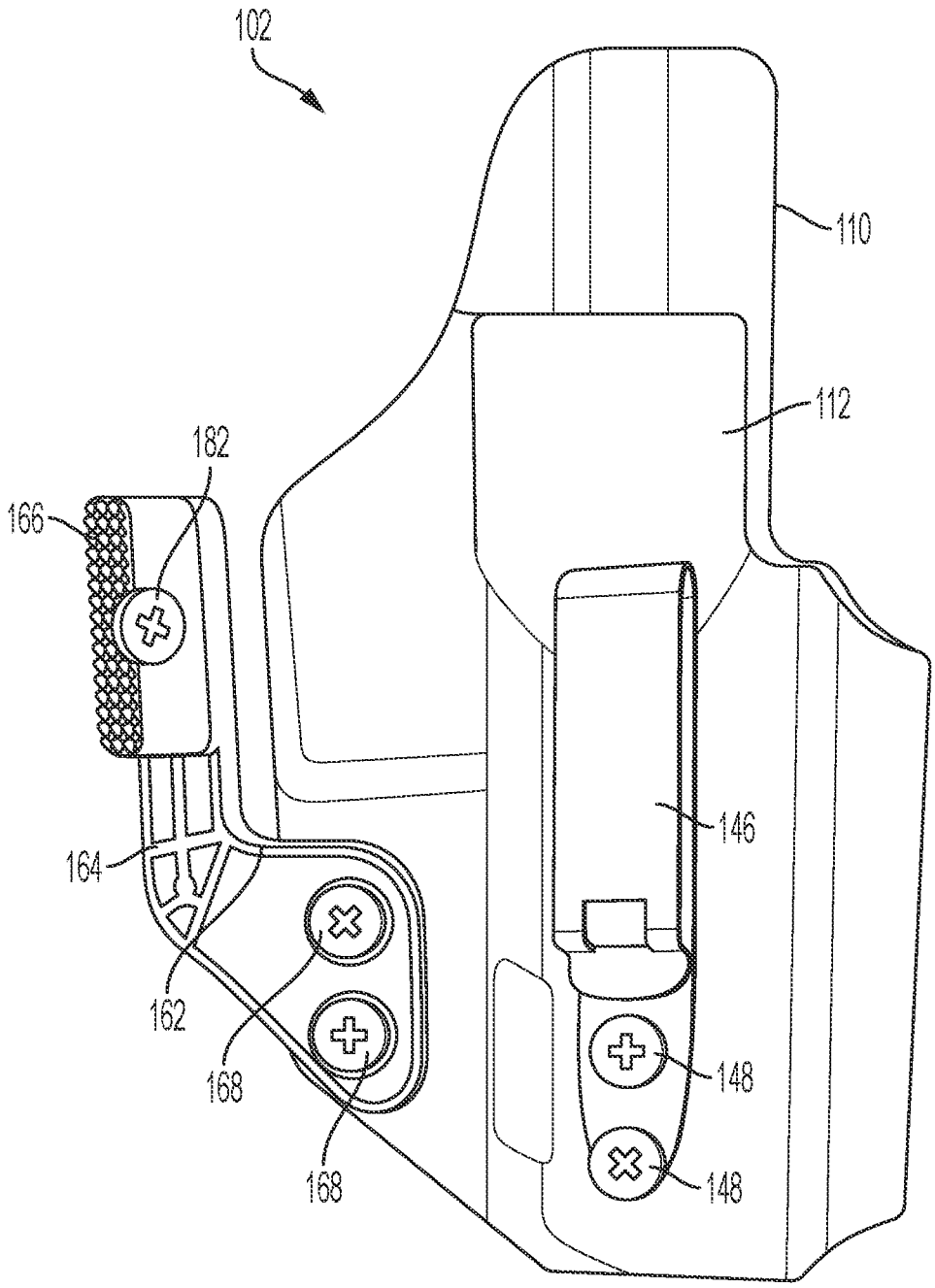
FIG. 3I illustrates an outside view of the disclosed concealment holster for use in an inside the waist carry position and with a mod wing.
Figure 4A:
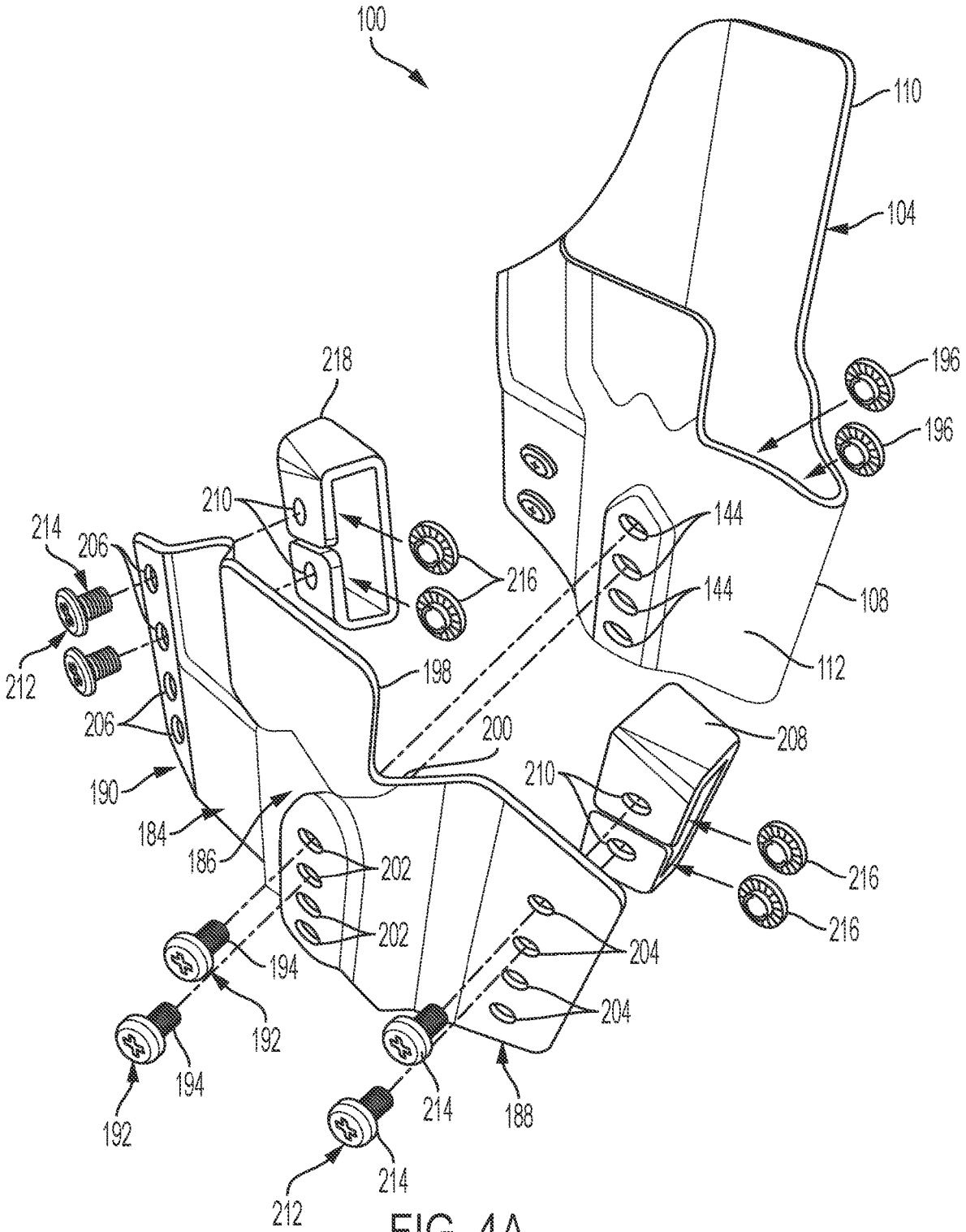
FIG. 4A illustrates assembly of the disclosed concealment holster for use in an outside the waist carry position.
Figure 4B:
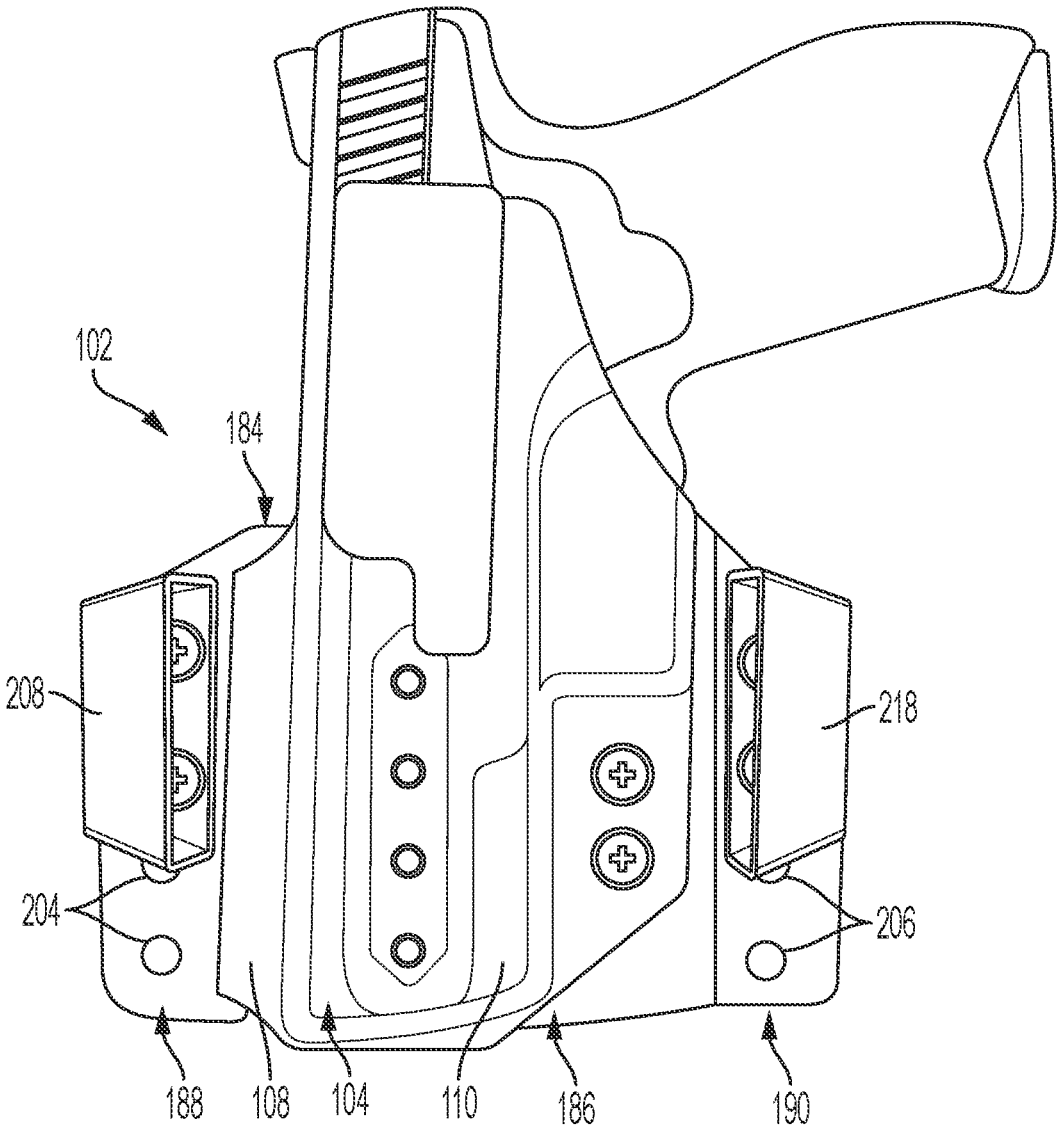
FIG. 4B illustrates an inside view of the disclosed concealment holster for use in an outside the waist carry position.
Figure 4C:
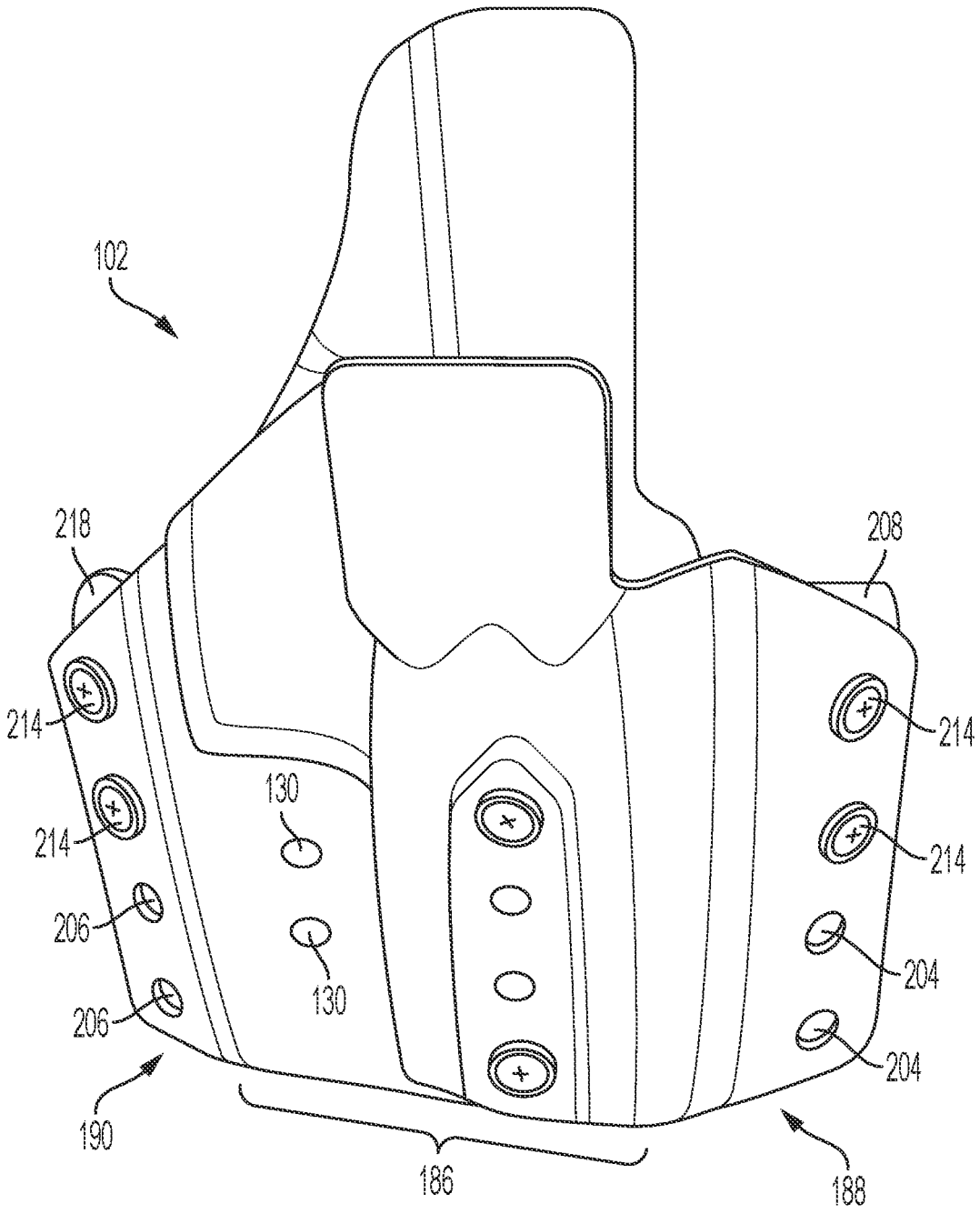
FIG. 4C illustrates an outside view of the disclosed concealment holster for use in an outside the waist carry position.
Figure 4D:
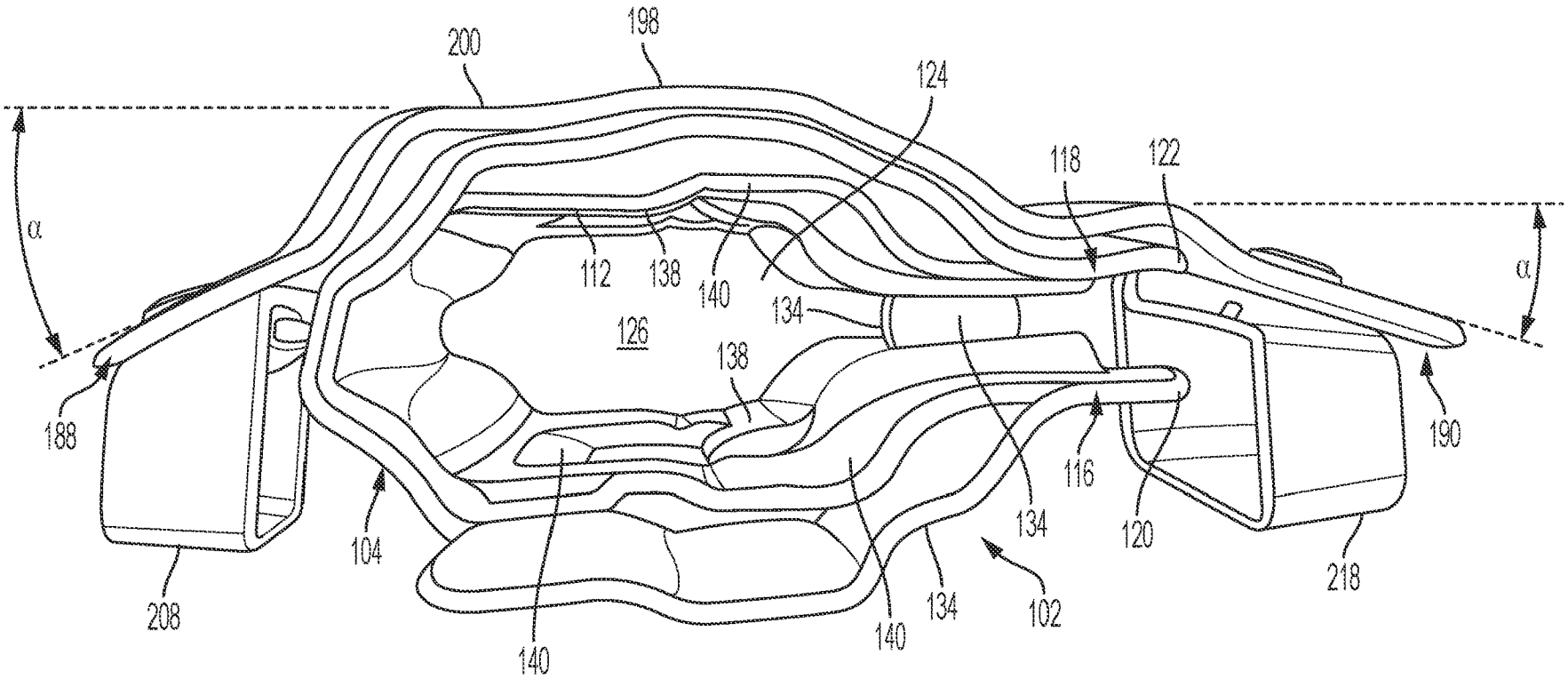
FIG. 4D illustrates a top view of the disclosed concealment holster for use in an outside the waist carry position.

The inside portion 110 has a terminal end portion 116 and the outside portion 112 has a terminal end portion 118. Each terminal end portion 116, 118 terminates in an edge 120, 122, respectively. The terminal end portion 116 of the inside portion 110 and the terminal end portion 118 of the outside portion 112 are (e.g., as shown in FIG. 3D) substantially parallel (e.g., being within 15 degrees of parallel or otherwise being close enough to parallel such that the unitary shell 104 functions as described herein). The edge 120 of the inside terminal end portion 118 and the edge 122 of the outside terminal end portion 118 are coplanar (e.g., as shown in FIGS. 3D and 4D).

The unitary shell 104 has an open top 124 and open bottom 126 formed by the relationship between the inside portion 110, front side portion 108, and outside portion 112. The open top 124 is sized to accommodate a firearm when inserted into the unitary shell 104 through the open top 124 in a barrel first orientation (e.g., as shown in FIGS. 1A-1C). The inside portion 110 of the unitary shell 104 and the outside portion 112 of the unitary shell 104 are shaped to accommodate a specific firearm or set of firearms. For example, the unitary shell 104 can be thermoformed using a mold, cast, or the like of a particular firearm for which the concealment holster assembly 100 is to be used. As a result of being thermoformed to accommodate a specific firearm, the inside 110 and outside portions 112 include a plurality of rises 138 and depressions 140 to accommodate features of a firearm when holstered. The features accommodated can include slide geometry, a trigger guard, receiver geometry, firearm controls and the like.

The terminal end portion 116 of the inside portion 110 and the terminal end portion 118 of the outside portion 112 are joined by a fastener 128. The fastener 128 joining the terminal end portion 118 of the outside portion 112 of the unitary shell 104 and the terminal end portion 116 of the inside portion 110 of the unitary shell 104 is adapted and configured to provide for adjustment of the spacing between the inside portion 110 and outside portion 112 such that a force of the inside portion and the outside portion gripping the firearm when holstered is adjustable. In other words, the spacing between the inside portion 110 and the outside portion 112 is adjustable using the fastener 128 such that the unitary shell 104 grips the firearm 106 either more tightly or more loosely thus changing the amount of force required to draw the firearm out of the holster. In some embodiments, a single fastener 128 is used. In alternative embodiments and the depicted embodiment, two fasteners 128 are used. Both the first fastener 128 and the second fastener 128 together provide for adjustment of the spacing between the inside portion 110 and outside portion 112 such that a force of the inside portion and the outside portion gripping the firearm when holstered is adjustable. The first fastener 128 and the second fastener 128 both comprise a through threaded nut 130 adapted and configured to receive a bolt, a bolt 132, and a compressible spacer 134. The compressible spacer 134 is positioned between the terminal end portion 118 of the outside portion 112 and the terminal end portion 116 of the inside portion 110. The bolt 132 and nut 130 are couplable to bring together the terminal end portions 116, 118. The bolt 132 and/or the threaded nut 130 extend though through holes 136 in the terminal end portions 116, 118 of the inside portion 110 and the outside portion 112.

The unitary shell also includes through holes for mounting additional components (e.g., a belt clip, belt attachment body, etc. as discussed later herein). The inside portion 110 has a plurality of through holes 142 each adapted and configured to receive a fastener. The outside portion 112 has a plurality of through holes 144 each adapted and configured to receive a fastener. The fasteners can be used to mount additional components. For example and as depicted in FIGS. 2A-2C, the concealment holster 102 can include a clip 146 attached using fasteners 148 (e.g., bolts, nuts, and/or washers, or other suitable fasteners). The plurality of through holes 142 and 144 on the unitary shell 104 can allow a user of the concealment holster 102 to adjust the height at which the holster is worn by attaching the clip 146 (or other component) to either higher or lower through holes 142, 144.

The clip 146 is adapted and configured to engage with a belt 147 (e.g., passed through belt loops 149 of the wearer's clothing) or item of clothing worn by the wearer of the concealment holster 102. The clip 146 (e.g., a belt clip) is removably couplable to the unitary shell 104 (e.g., using the fasteners 148). The belt clip 146 includes two substantially parallel portions 150 (e.g., deviating from parallel by up to 20 degrees). The parallel portions 150 are joined on one end 152 and un-joined on an opposite end 154. The two parallel portions 150 are adapted and configured to receive a belt of portion of clothing therebetween. One of the parallel portions 150 includes first 156 and second 158 through holes. The first 156 and second 158 through holes are each adapted and configured to receive a fastener 148 to couple the belt clip 146 to the unitary shell 104 via the plurality of through holes 144 in the outside portion 112 of the unitary shell 104. One of the first 156 and second 158 through holes being elongated laterally (e.g., through hole 156) to allow the angle between the belt clip 146 and the unitary shell 104 to be changed and thereby adjust the cant of the concealment holster 102 when worn.

Referring now to FIGS. 1A-1B and 3A-3I, in an alternative configuration permitted by the concealment holster assembly 100, the concealment holster 102 provides for carrying with a mod wing 160 in either an inside the waist and appendix position (1 o'clock position, shown in FIG. 1A) or an inside the waist and hip position (4 o'clock position, shown in FIG. 1B).

The mod wing 160 is removably couplable to the unitary shell 104. The mod wing 160 includes a lateral portion 162 extending laterally from the unitary shell 104 and a vertical portion 164 extending upwardly from the lateral portion 162. A spacer 166 is positioned at a terminus of the vertical portion 164. The vertical portion 164 is sized to position the spacer 166 at the height of a belt worn by the wearer of the concealment holster 102 (e.g., as shown in FIGS. 1A-1B). The spacer 166 is adapted and configured to engage with a belt of a wearer or other piece of clothing to rotate the concealment holster 102 rearwardly and inwardly when the concealment holster 102 is worn inside the waist. The lateral portion 162 of the mod wing is removably couplable to the unitary shell 104 via a bolt 168 engaging with the lateral portion 162 of the mod wing 160 and the nut portions 130 (e.g., shown in FIG. 2C) of the fasteners 128 joining the terminal end portion 118 of the outside portion 112 of the unitary shell and the terminal end portion 116 of the inside portion 110 of the unitary shell 104. This method of coupling the mod wing 160 to the unitary shell 104 is advantageous in that a single fastener 128 performs two functions, adjusting the retention force of the concealment holster 102 on a holstered firearm and coupling the mod wing 160 to the unitary shell 104 of the concealment holster 102.

The concealment holster assembly 100 further including a second spacer 170. The spacer 166 and the second spacer 170 are removably couplable to the vertical portion 164 of the mod wing 160. The vertical portion 164 of the mod wing 160 includes two through holes 172 each adopted and configured to receive a post 174 of a spacer 166, 170. The vertical portion 164 of the mod wing 160 includes a hexagonal through hole 176 adapted and configured to receive a hexagonal nut 178 and/or a hexagonal post 180 of a spacer 166, 170. The spacer 166 has a greater height than the second spacer 170 such that the spacer 166 provides for greater rotation of the concealment holster 102 when worn (the greater height engaging with the wearer's belt to provide greater rotation). The spacer 166 and the second spacer 170 each include two posts 174 adapted and configured to engage with corresponding through holes 172 of the vertical portion 164 of the mod wing 160 and a hexagonal post 180 adapted and configured to engage with a corresponding hexagonal through hole 176 in the vertical portion 164 of the mod wing 160. Either the spacer 166 or the second spacer 170 are securable to the vertical portion 164 of the mod wing 160 by a bolt 182 engaging with either the spacer 166 or the second spacer 170 and with a hexagonal nut 178 within the hexagonal through hole 176 of the vertical portion 164 of the mod wing 160.

Referring now to FIGS. 1C and 4A-4D, the concealment holster assembly 100 includes a belt attachment body 184 for modifying the concealment holster 102 for use in an outside the waist carry position (e.g., as shown in FIG. 1C). The unitary shell 104 is stripped of components for use in other carry positions in order to be modified for use in an outside the waist carry position. For example, the belt clip 146 and/or mod wing 160 are removed from the unitary shell 104 by removing the fasteners coupling such components to the unitary shell 104. The belt attachment body 184 is then coupled to the unitary shell 104.

The belt attachment body 184 is of unitary construction and is adapted and configured to facilitate wearing of the concealment holster outside the waist. The belt attachment body includes a complementary shell portion 186, a forward flange 188, and a rearward flange 190. The belt attachment body 184 is removably couplable to the unitary shell 104 using fasteners 192 (e.g., bolts 194 and nuts 196). The complementary shell portion 186 is formed to include a plurality of rises 198 and depressions 200 corresponding to the plurality of rises 138 and depressions 140 of the outside portion 112 of the unitary shell 104 such that when the belt attachment body 184 is coupled to the unitary shell 104, the outside portion 112 of the unitary shell 104 and the complimentary shell portion 186 of the belt attachment body 184 are substantially coterminous. This provides for the belt attachment body 184 is as closely coupled to the unitary shell 104 as possible thus aiding concealment of the concealment holster 102. The complementary shell portion 186 includes rises and depressions in order to match those of the unitary shell 104 which in turn makes the belt attachment body 184 firearm specific as the unitary shell 104 is firearm specific.

The complimentary shell portion 186 of the belt attachment body 184 includes a plurality of through holes 202 each adapted and configured to receive a fastener 192 such that the belt attachment body is couplable to the unitary shell via at least two of the plurality of through holes 144 of the outside portion 112 of the unitary shell 104. The forward flange 188 extends forward from the complementary shell portion 186 and is angled inward toward the inside portion 110 of the unitary shell 104. The forward flange 188 includes a plurality of through holes 204. The rearward flange 190 extends rearward from the complementary shell portion 186 and is angled inward toward the inside portion 110 of the unitary shell 104. The rearward flange 190 including a plurality of through holes 206.

A forward belt loop 208 is adapted and configured to be securable to a belt (e.g., as shown in FIG. 1C). The forward belt loop 208 includes a plurality of through holes 210. The forward belt loop 208 is couplable to the forward flange 188 of the belt attachment body 184 using a plurality of fasteners 212 (e.g., bolt 214 and nut 216), the plurality of through holes 210 of the forward belt loop 208, and the plurality of through holes 204 of the forward flange 188 of the belt attachment body 184.

A rearward belt loop 218 is adapted and configured to be securable to a belt. The rearward belt loop 218 includes a plurality of through holes 210. The rearward belt loop 218 is couplable to the rearward flange 190 of the belt attachment body 184 using a plurality of fasteners 212, the plurality of through holes 210 of the rearward belt loop 218, and the plurality of through holes 206 of the rearward flange 190 of the belt attachment body 184.

The placement of the forward belt loop 208 on the angled forward flange 188 and placement of the rearward belt loop 218 on the angled rearward flange 190 cause the belt attachment body 184, when worn on a belt, to flex inward toward a body of a wearer and increase concealment of the concealment holster 102 and a firearm when the firearm is holstered. In other words, the tension provided by the belt on the angled flanges 188, 190 causes flexion in the belt attachment body 184 and brings the entirety of the concealment holster 102 closer to the wearers body and thus enhances concealment when the concealment holster 102 is worn in an outside the waist carry position.

The plurality of through holes 202 of the complimentary shell portion 186 of the belt attachment body 184 includes at least four through holes arranged vertically such that the height of the unitary shell 104, when the concealment holster is worn, is adjustable by coupling the unitary shell 104 to selected through holes 202 of the plurality of through holes 202 of the complimentary shell portion 186 of the belt attachment body 184. This allows the "ride height" of the concealment holster 102 to be adjusted to fit an individual user/wearer's preference. The plurality of through holes 202 can be used in conjunction with the similar plurality of through holes 144 of the unitary shell 104 to further adjust the positioning of the unitary shell 104 relative to the belt attachment body 184 which is fixed relative to the belt worn by the user when attached to the belt.

The plurality of through holes 204 of the forward flange 188 of the belt attachment body 184 includes at least 4 through holes arranged vertically. The plurality of through holes 206 of the rearward flange 190 of the belt attachment body 184 similarly include at least 4 through holes arranged vertically. This arrangement allows for further adjustment of the height of the unitary shell 104, and thus the firearm, when the concealment holster 102 is worn on a user's belt. For example, by using the top two through holes 204, 206 of the forward and rearward flanges 188, 190 to mount the forward and rearward belt loops 208, 218, the unitary shell 104 and thus the firearm will be positioned in a lower position. Likewise, using the bottom two through holes 204, 206 raises the unitary shell 104 and the firearm in higher position. Additionally, the plurality of through holes 204, 206 allow for placement of the forward and rearward belt loops 208, 218 to adjust the cant of the unitary shell 104 when the concealment holster 102 is worn. The cant can be adjusted by selectively attaching the forward belt loop 208 to a subset of the plurality of through holes 204 of the forward flange 188 and selectively attaching the rearward belt loop 218 to a subset of the plurality of through holes 206 of the rearward flange 190. For example, by mounting the rearward belt loop 218 using the top through holes 206 and mounting the forward belt loop 208 using the bottom through holes 204, the unitary shell 104 and the firearm holstered in the concealment holster 102 are canted forward.

Referring now generally to FIGS. 1A-4D, the unitary shell 104 is thermoformed from a thermoplastic sheet of substantially uniform thickness. The unitary shell 104 is of uniform thickness. The belt attachment body 184 being thermoformed from a thermoplastic sheet of substantially uniform thickness. The belt attachment body 184 is of uniform thickness. The thickness of the unitary shell 104 is the same as the thickness of the belt attachment body 184, both being formed from the same thermoplastic sheet material. This configuration provides several advantages. The rigidity of both the unitary shell 104 and the belt attachment body 184 are substantially uniform, varying only due to geometry. This provides for unitary fee and comfort for the wearer and predictable behavior of the concealment holster 102. The configuration also provides advantages in simplifying manufacture while also maintaining the other advantages of the configuration.

In some embodiments, the thickness of the unitary shell 104 and the thickness of the belt attachment body 184 is between 2.75 millimeters and 3.5 millimeters, inclusive. In some embodiments, the thickness of the unitary shell 104 and the thickness of the belt attachment body 184 is between 3 millimeters and 3.25 millimeters, inclusive. It has been determined experimentally that these thicknesses provide for optimum performance of the concealment holster assembly 100. Such thickness, combined with a particular material construction as described herein, provide for sufficient rigidity, gripping force on the firearm, and sufficient flexibility in the belt attachment body 184 to provide for the enhanced concealment discussed herein provided by the belt flexing the belt attachment body 184 and bring it in towards a user's body to enhance concealment.

Referring now to FIGS. 1A-4D generally and FIG. 4D specifically, in some embodiments, the forward flange 188 and rearward flange 190 of the belt attachment body 184 extend from the complimentary shell portion 186 at an angle $\alpha$, relative to the complimentary shell portion 104, of between 15 and 30 degrees, inclusive. In some embodiments, the angle α is between 16 and 18 degrees, inclusive. In still further embodiments, the angle α is between 23 and 25 degrees, inclusive. In the preferred and depicted embodiment, the angle α is 24 degrees. It has been determined experimentally that these angles α, and particularly an angle α of 24 degrees, provides for a particular increased concealment of concealment holster 102 when worn in an outside the waist configuration. This results from the angle of the flanges 188, 190 and the flexibility provided by the material construction and geometry (e.g., thickness, ridges, rises, depressions, etc.). An angle α of 24 degrees positions the belt loops 208 and 218, along with other features, to provide for sufficient flex from the user's belt to draw the concealment holster 102 in toward the wearer and enhance concealment. The angle likewise moves portions of the belt attachment body 184 inward and enhances concealment (e.g., moves in belt loops 208 and 218).

Referring again to FIGS. 1A-4D generally, in some embodiments, the unitary shell 104 and the belt attachment body 184 are made of a thermoplastic acrylic-polyvinyl chloride material. Such a material provides for the features and functions described herein in conjunction with other features of the concealment holster assembly 100 (e.g., geometry of the unitary shell 104 and belt attachment body 184). Such a material can have a specific gravity of between 1.38 and 1.47, inclusive; a tensile strength of between 36 MPa and 42.8 MPa, inclusive; flexural strength of between 61 MPa and 64.9 MPa, inclusive; Rockwell Hardness (ASTM D785) of between 108-111; and other mechanical properties.

Changes can be made in the above constructions without departing from the scope of the disclosure. It is intended that all matter contained in the above description or shown in the accompanying drawings shall be interpreted as illustrative and not in a limiting sense.

I claim:

1. A concealment holster assembly capable of being worn in multiple positions, the concealment holster assembly comprising:

a unitary shell, the unitary shell having a front side portion, inside portion, and outside portion, the inside portion being adapted and configured to face a wearer when the concealment holster is worn, the outside portion being adapted and configured to face away from a wearer when the concealment holster is worn, the front side portion joining the inside portion and the outside portion, the inside portion having a terminal end portion and the outside portion having a terminal end portion, each terminal end portion terminating in an edge, the terminal end portion of the inside portion and the terminal end portion of the outside portion being substantially parallel, the edge of the inside terminal end portion and the edge of the outside terminal end portion being coplanar, the unitary shell having an open top and open bottom formed by the relationship between the inside portion, front side portion, and outside portion, the open top being sized to accommodate a firearm when inserted into the shell through the open top in a barrel first orientation, the terminal end portion of the inside portion and the terminal end portion of the outside portion being joined by a fastener, the inside portion having a plurality of through holes each adapted and configured to receive a fastener, the outside portion having a plurality of through holes each adapted and configured to receive a fastener;

a belt attachment body, the belt attachment body being of unitary construction and being adapted and configured to facilitate wearing of the concealment holster outside the waist, the belt attachment body comprising a complementary shell portion, a forward flange, and a rearward flange, the belt attachment body removably couplable to the unitary shell, the complimentary shell portion including a plurality of through holes each adapted and configured to receive a fastener such that the belt attachment body is couplable to the unitary shell via at least two of the plurality of through holes of the outside portion of the unitary shell, the forward flange extending forward from the complementary shell portion and being angled inward toward the inside portion of the unitary shell, the forward flange including a plurality of through holes, the rearward flange extending rearward from the complementary shell portion and being angled inward toward the inside portion of the unitary shell, the rearward flange including a plurality of through holes;

a forward belt loop adapted and configured to be securable to a belt, the forward belt loop including a plurality of through holes, the forward belt loop being couplable to the forward flange of the belt attachment body using a plurality of fasteners, the plurality of through holes of the forward belt loop, and the plurality of through holes of the forward flange of the belt attachment body; and a rearward belt loop adapted and configured to be securable to a belt, the rearward belt loop including a plurality of through holes, the rearward belt loop being couplable to the rearward flange of the belt attachment body using a plurality of fasteners, the plurality of through holes of the rearward belt loop, and the plurality of through holes of the rearward flange of the belt attachment body, wherein placement of the forward belt loop on the angled forward flange and placement of the rearward belt loop on the angled rearward flange cause the belt attachment body, when worn on a belt, to flex inward toward a body of a wearer and increase concealment of the concealment holster and a firearm when the firearm is holstered.

2. A concealment holster assembly in accordance with claim 1, the unitary shell being thermoformed from a thermoplastic sheet of substantially uniform thickness.

3. A concealment holster assembly in accordance with claim 1, the unitary shell being of uniform thickness.

4. A concealment holster assembly in accordance with claim 1, the belt attachment body being thermoformed from a thermoplastic sheet of substantially uniform thickness.

5. A concealment holster assembly in accordance with claim 1, the belt attachment body being of uniform thickness.

6. A concealment holster assembly in accordance with claim 1, the unitary shell being of uniform thickness, the belt attachment body being of uniform thickness, and wherein the thickness of the unitary shell is the same as the thickness of the belt attachment body.

7. A concealment holster assembly in accordance with claim 6, wherein the thickness of the unitary shell and the thickness of the belt attachment body is between 2.75 millimeters and 3.5 millimeters, inclusive.

8. A concealment holster assembly in accordance with claim 7, wherein the thickness of the unitary shell and the thickness of the belt attachment body is between 3 millimeters and 3.25 millimeters, inclusive.

9. A concealment holster assembly in accordance with claim 1, wherein the forward flange and rearward flange extend from the complimentary shell portion at an angle, relative to the complimentary shell portion, of between 15 and 30 degrees, inclusive.

10. A concealment holster assembly in accordance with claim 9, wherein the forward flange and rearward flange extend from the complimentary shell portion at an angle, relative to the complimentary shell portion, of between 16 and 18 degrees, inclusive.

11. A concealment holster assembly in accordance with claim 9, wherein the forward flange and rearward flange extend from the complimentary shell portion at an angle, relative to the complimentary shell portion, of between 23 and 25 degrees, inclusive.

12. A concealment holster assembly in accordance with claim 1, wherein the plurality of through holes of the complimentary shell portion of the belt attachment body comprises at least four through holes arranged vertically such that the height of the unitary shell when the concealment holster is worn is adjustable by coupling the unitary shell to selected through holes of the plurality of through holes of the complimentary shell portion of the belt attachment body.

13. A concealment holster assembly in accordance with claim 1, wherein the plurality of through holes of the forward flange of the belt attachment body comprise at least 4 through holes arranged vertically, wherein the plurality of through holes of the rearward flange of the belt attachment body comprise at least 4 through holes arranged vertically, and wherein the cant of the unitary shell when the concealment holster is worn is adjustable by selectively attaching the forward belt loop to a subset of the plurality of through holes of the forward flange and selectively attaching the rearward belt loop to a subset of the plurality of through holes of the rearward flange.

14. A concealment holster assembly in accordance with claim 1, further comprising a belt clip removably couplable to the unitary shell, the belt clip comprising two parallel portions joined on one end and un-joined on an opposite end, the two parallel portions adapted and configured to receive a belt of portion of clothing therebetween, one of the parallel portions having first and second through holes, the first and second through holes each adapted and configured to receive a fastener to couple the belt clip to the unitary shell via the plurality of through holes in the outside portion of the unitary shell, one of the first and second through holes being elongated laterally to allow the angle between the belt clip and the unitary shell to be changed and thereby adjust the cant of the concealment holster when worn.

15. A concealment holster assembly in accordance with claim 1, wherein the inside portion of the unitary shell and outside portion of the unitary shell are shaped to accommodate a specific firearm or set of firearms, the inside and outside portions including a plurality of rises and depressions to accommodate features of a firearm when holstered, the complementary shell portion being formed to include a plurality of rises and depressions corresponding to the plurality of rises and depressions of the outside portion of the unitary shell such that when the belt attachment body is coupled to the unitary shell, the outside portion of the unitary shell and the complimentary shell portion of the belt attachment body are substantially coterminous.

16. A concealment holster assembly in accordance with claim 1, wherein the fastener joining the terminal end portion of the outside portion of the unitary shell and the terminal end portion of the inside portion of the unitary shell adapted and configured to provide for adjustment of the spacing between the inside portion and outside portion such that a force of the inside portion and the outside portion gripping the firearm when holstered is adjustable.

17. A concealment holster assembly in accordance with claim 16, comprising a first fastener joining the terminal end portion of the outside portion of the unitary shell and the terminal end portion of the inside portion of the unitary shell and a second first fastener joining the terminal end portion of the outside portion of the unitary shell and the terminal end portion of the inside portion of the unitary shell, both the first fastener and the second fastener providing for adjustment of the spacing between the inside portion and outside portion such that a force of the inside portion and the outside portion gripping the firearm when holstered is adjustable, and wherein the first fastener and the second fastener both comprise a through threaded nut adapted and configured to receive a bolt, a bolt, and a compressible spacer, the compressible spacer positioned between the terminal end portion of the outside portion and the terminal end portion of the inside portion, the bolt and nut couplable to bring together the terminal end portion of the outside portion and the terminal end portion of the inside portion.

18. A concealment holster assembly in accordance with claim 17, further comprising a mod wing removably couplable to the unitary shell, the mod wing comprising a lateral portion extending laterally from the unitary shell, a vertical portion extending upwardly from the lateral portion, and a spacer positioned at a terminus of the vertical portion, the vertical portion sized to position the spacer at the height of a belt worn by the wearer of the concealment holster, the spacer adapted and configured to engage with a belt of a wearer to rotate the concealment holster rearwardly and inwardly when the concealment holster is worn inside the waist, and wherein the lateral portion of the mod wing is removably couplable to the unitary shell via a bolt engaging with the lateral portion of the mod wing and the nut portions of the fasteners joining the terminal end portion of the outside portion of the unitary shell and the terminal end portion of the inside portion of the unitary shell.

19. A concealment holster assembly in accordance with claim 18, further including a second spacer, wherein the spacer and the second spacer are removably couplable to the vertical portion of the mod wing, the vertical portion of the mod wing including two through holes each adopted and configured to receive a post of the spacer and the vertical portion of the mod wing including a hexagonal through hole adapted and configured to receive a hexagonal nut, the second spacer having a greater height than the spacer such that the second spacer provides for greater rotation, and wherein the spacer and the second spacer each include two posts adapted and configured to engage with corresponding through holes of the vertical portion of the mod wing and a hexagonal post adapted and configured to engage with a corresponding hexagonal through hole in the vertical portion of the mod wing, either the spacer or the second spacer being securable to the vertical portion of the mod wing by a bolt engaging with either the spacer or the second spacer and with a hexagonal nut within the hexagonal through hole of the vertical portion of the mod wing.

20. A concealment holster in accordance with claim 1, wherein the unitary shell and the belt attachment body comprise a thermoplastic acrylic-polyvinyl chloride material.

* * * * *